US006942502B2

(12) United States Patent
Sharples

(10) Patent No.: US 6,942,502 B2
(45) Date of Patent: Sep. 13, 2005

(54) RETRACTABLE ELECTRIC WALL OUTLET ASSEMBLY

(76) Inventor: Stanley S. Sharples, 3407 Pendleton Way, Land O Lakes, FL (US) 34639

( * ) Notice: Subject to any disclaimer, the term of this patent is extended or adjusted under 35 U.S.C. 154(b) by 0 days.

(21) Appl. No.: 10/735,328

(22) Filed: Dec. 12, 2003

(65) Prior Publication Data

US 2005/0130467 A1 Jun. 16, 2005

(51) Int. Cl.[7] ..... H01R 13/44
(52) U.S. Cl. ..... 439/131; 174/48
(58) Field of Search ..... 439/131–132, 439/135, 142, 373, 535–536; 174/66.67, 174/48, 51, 67; 220/3.8, 241–242

(56) References Cited

U.S. PATENT DOCUMENTS 5,575,668 A * 11/1996 Timmerman ..... 439/131
5,755,582 A * 5/1998 Charlton ..... 439/131
6,046,405 A * 4/2000 Obermann ..... 174/57
6,290,518 B1 * 9/2001 Byrne ..... 439/131
6,478,587 B2 * 11/2002 Sharples ..... 439/131

* cited by examiner

*Primary Examiner*—Gary Paumen
*Assistant Examiner*—Edwin A. Leon
(74) *Attorney, Agent, or Firm*—Dale J. Ream

(57) ABSTRACT

A retractable electric wall outlet assembly for providing selective access to receptacles includes a cover plate with an electrical box pivotally coupled for movement therethrough. The electrical box includes electrical receptacles and is pivotally movable between a retracted configuration in which the receptacles are not accessible and an extended configuration in which the receptacles are accessible. An electric box front surface is generally flush with a cover plate front surface at the retracted configuration while the electric box is forwardly extended at the extended configuration. A latch assembly including a latch member and slot structure is mounted to a rear surface of the electric box and cover plate for selectively holding or releasing the electric box to move between configurations. The latch member is biased to be selectively held or released from cooperating deep and shallow slots regulates movement between configurations.

12 Claims, 5 Drawing Sheets

RETRACTABLE ELECTRIC WALL OUTLET ASSEMBLY

BACKGROUND OF THE INVENTION

This invention relates generally to electric outlets and receptacles and, more particularly, to a retractable electric wall outlet assembly for providing selective access to electric receptacles.

Conventional wall outlets are often disadvantageous in that electrical plugs received therein sometimes prevent items such as furniture from being positioned as desired or are inadvertently disconnected or damaged by furniture. In addition, electrical plug receptacles are a well-known hazard for curious young children who may insert their fingers or metal objects (e.g. paperclips) therein. Although various devices have been proposed in the art for regulating access to electric receptacles, the existing devices do not provide a convenient push button assembly that is not subject to mechanical failure.

Therefore, it is desirable to have an electric wall outlet assembly that is selectively retractable and extensible and which is not subject to mechanical failure.

SUMMARY OF THE INVENTION

A retractable electric wall outlet assembly for providing selective access to electric receptacles includes a cover plate defining a central opening. The assembly further includes an electric box having electrical receptacles, the electric box being pivotally coupled to the cover plate and spring biased for movement through the cover plate central opening. The electric box is movable between a retracted/inoperable configuration in which the electrical receptacles are made inaccessible to persons and an extended/operable configuration in which the receptacles are accessible.

The assembly includes a latch assembly for selectively holding the electric box in the retracted configuration and for selectively releasing the electric box to move to the extended configuration. The latch assembly includes a latch member in cooperation with a track structure. The track structure includes deep and shallow slots with a recess therebetween such that there are no working mechanical parts that would be subject to failure.

Therefore, it is a general object of this invention to provide a retractable electric wall outlet assembly for selectively providing access to electric receptacles.

Another object of this invention is to provide an electric wall outlet assembly, as aforesaid, having a latch assembly that is not subject to mechanical failure.

Still another object of this invention is to provide an electric wall outlet assembly, as aforesaid, which urges an electric box between retracted and extended configurations with the ease of push-button structures.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

A retractable electric wall outlet assembly for providing selective access to electrical receptacles will now be described in detail with reference to FIGS. 1 through 5 of the accompanying drawings.

Figure 1:
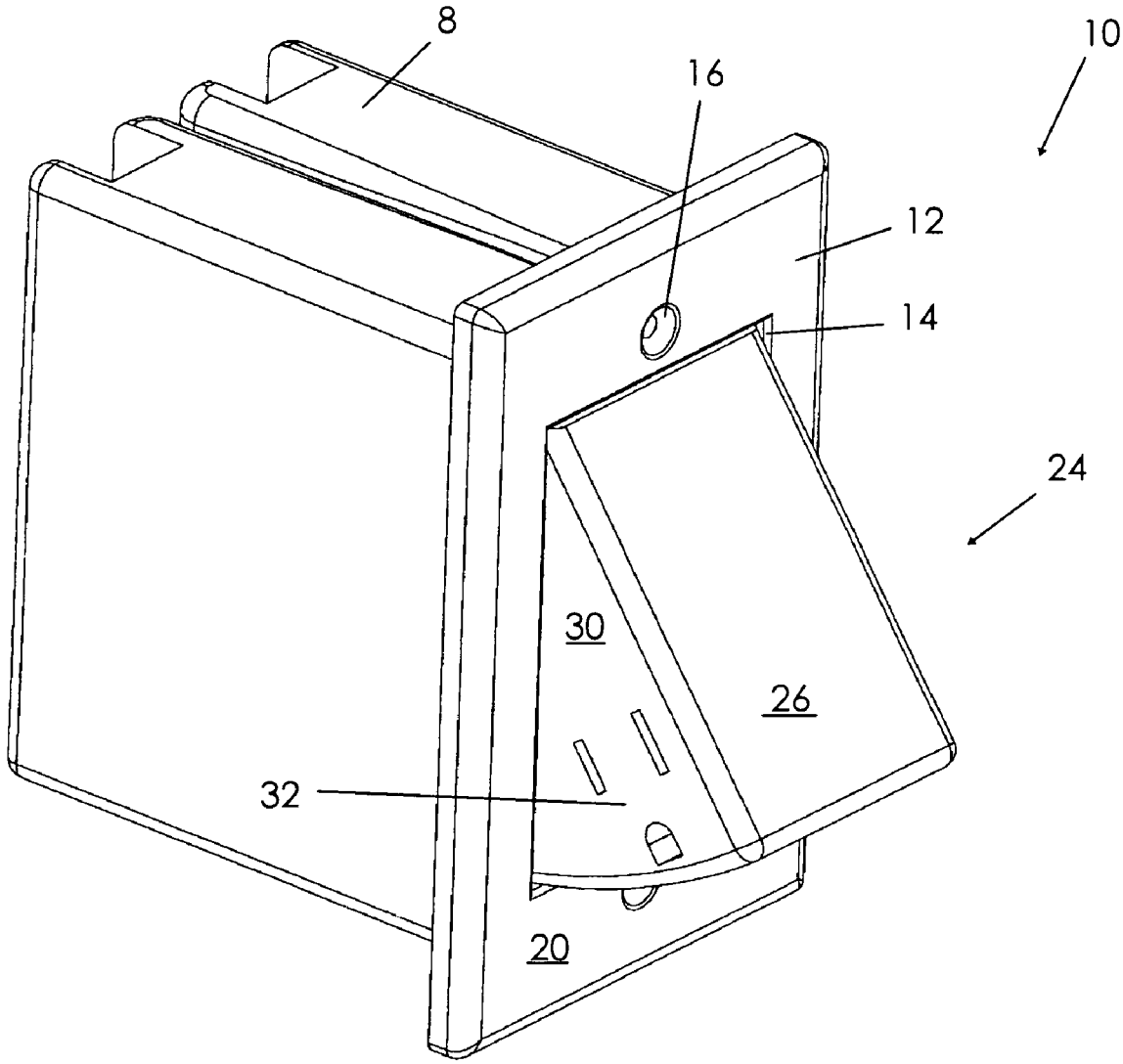
FIG. 1 is a perspective view of a wall outlet assembly according to one embodiment of the present invention in use with a conventional electric wall outlet housing.
Figure 2:
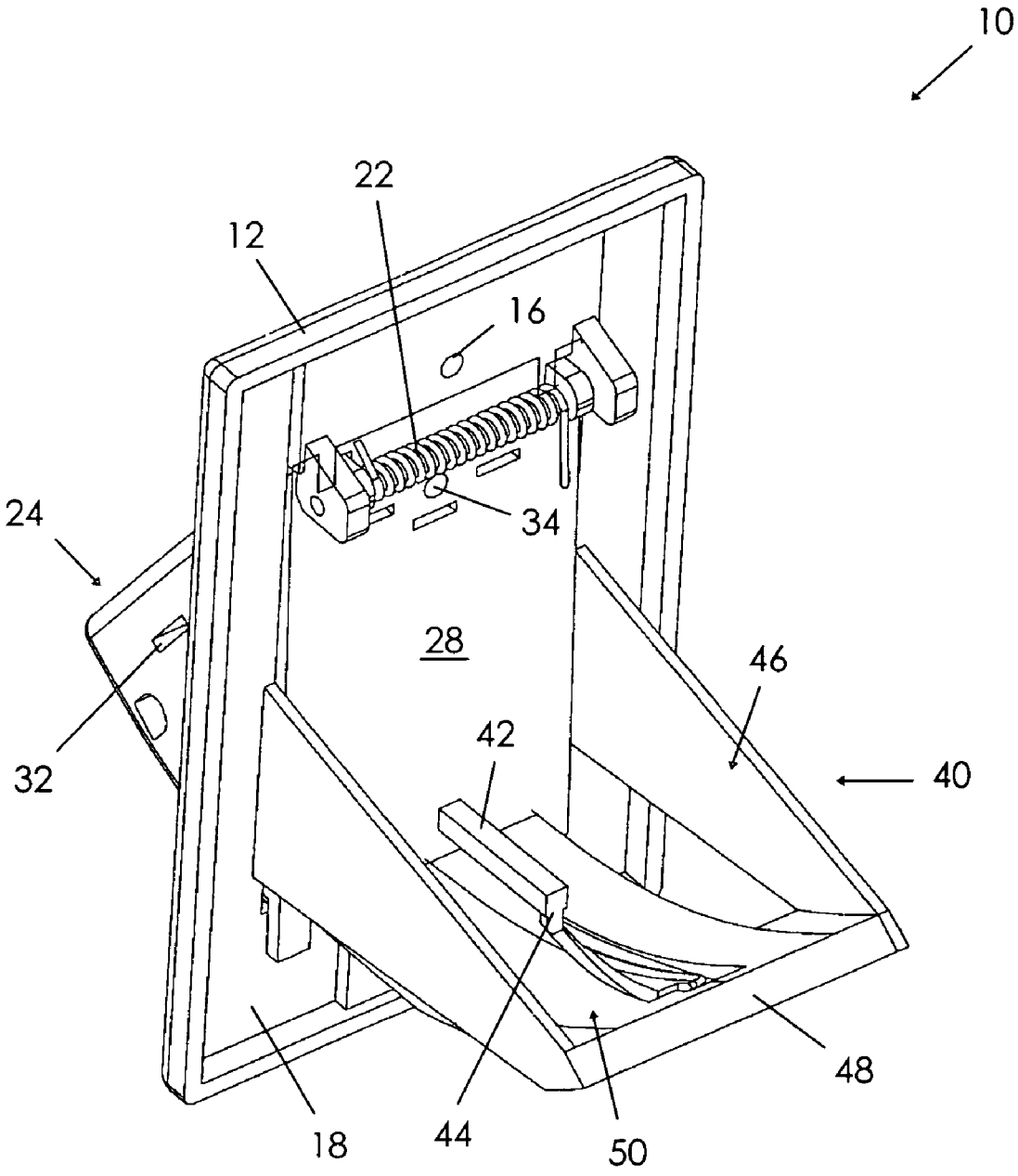
FIG. 2 is a rear perspective view of the wall outlet assembly as in FIG. 1 removed from the electric wall outlet housing.
Figure 3:
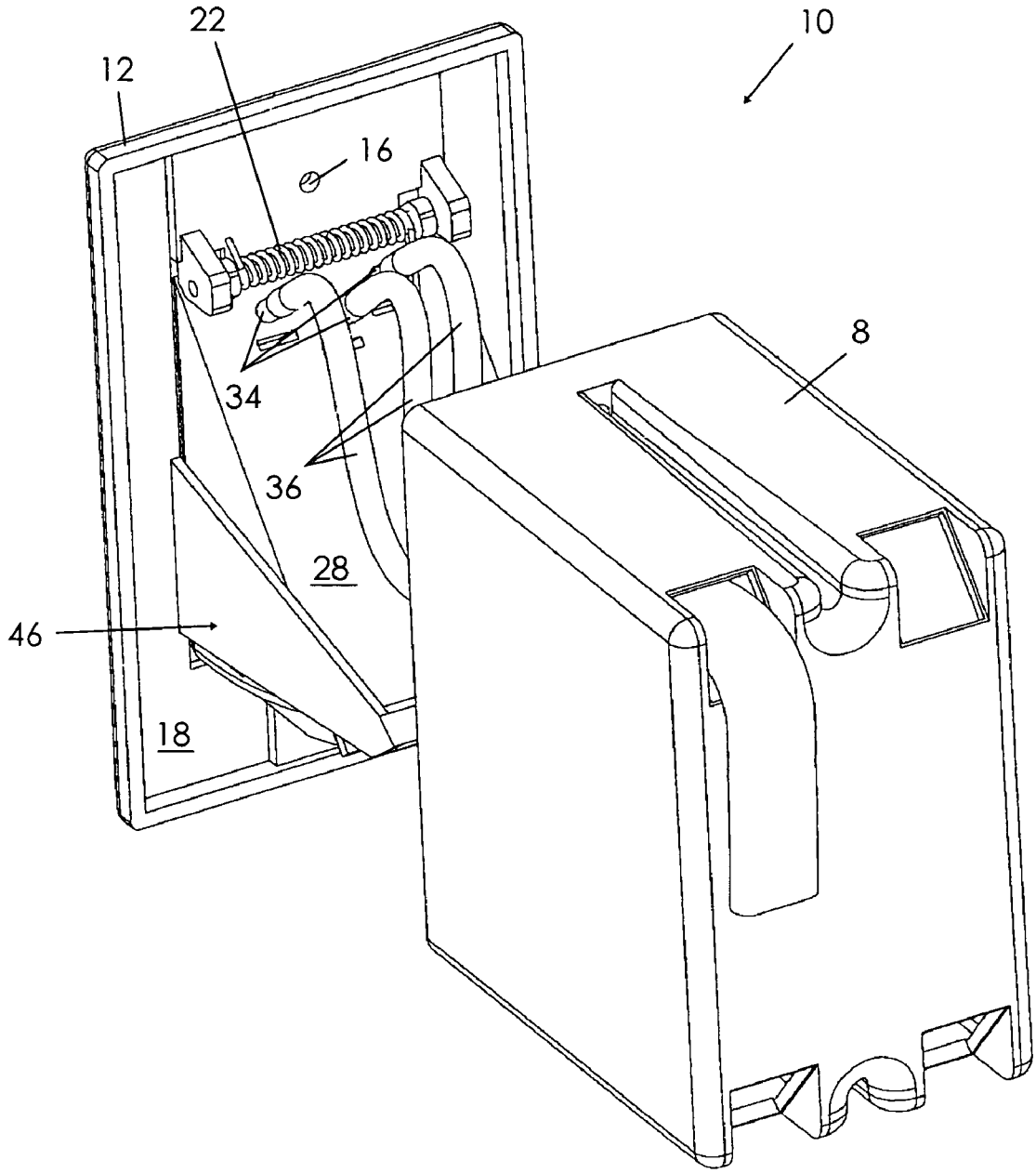
FIG. 3 is a rear perspective view of the wall outlet assembly as in FIG. 1 separated from the electric wall outlet housing and showing electrical wire connections.

A retractable electric wall outlet assembly 10 according to one embodiment of the invention is shown in FIGS. 1 to 4 and includes a cover plate 12 and an electric box 24 coupled thereto. More particularly, the cover plate 12 includes a generally rectangular configuration and defines a generally rectangular opening 14 therethrough. The dimensions of the opening 14 are substantially similar to the dimensions of a conventional wall socket opening such that the cover plate 12 may overlay the opening of a conventional wall socket assembly. The cover plate 12 includes standard screw holes 16 and may be mounted to a wall with screws in a conventional manner. The cover plate opening 14 is also dimensioned to enable the electric box 24 to move therethrough, as will be further described in detail below. While the cover plate 12 is an important component of the present invention, the electric wall outlet assembly 10 may be used with a conventional electrical wall outlet housing 8 (FIGS. 1 and 3).

Preferably, the electric box 24 is pivotally mounted to the rear surface 18 of the cover plate 12 adjacent an upper edge of the cover plate opening 14 as shown in FIG. 2 although being pivotally mounted adjacent another edge would also be suitable. Further, the electric box 24 may even include a pop-up mount instead of the pivotal mount shown in the drawings. More particularly, the electric box 24 is axially mounted to the rear surface 18 of the cover plate 12 such that the electric box 24 is pivotally movable about the axial mount between a retracted configuration in which a front surface 26 of the electric box 24 is substantially flush with a front surface 20 of the cover plate 12 (FIG. 3) and an extended configuration in which the front surface 26 of the electric box 24 is forwardly displaced from the cover plate front surface 20 (FIG. 1).

A torsion spring 22 is mounted to the rear surface 18 of the cover plate 12 and arranged about the axial mount (FIG. 2). The spring 22 is also connected to the electric box 24 for biasing the electric box 24 toward the extended/operable configuration. Other spring arrangements, whether metal or plastic, would also be suitable to bias the electric box 24 in a desired direction.

The electric box 24 includes a pair of electrical receptacles 32, preferably positioned on opposed side panels 30 of the electric box 24 although a single or plurality of receptacles would be suitable. The electric box 24 further includes electrical terminals 34 for connection to electrical service wires 36 of the house or building where the assembly 10 is being utilized (FIG. 3). Therefore, the receptacles 32 are inaccessible and inoperable when the electric box 24 is at the retracted configuration (FIG. 3) and are accessible and operable when the electric box 24 is at the extended configuration (FIG. 1).

Further, the electric wall outlet assembly 10 includes a latch assembly 40 for selectively holding and releasing the electric box 24 between retracted and extended configurations. Preferably, the latch assembly 40 includes an elongate latch member 42 mounted to a rear surface 28 of the electric box 24 and extends outwardly therefrom (FIG. 2). The latch member 42 thus defines a longitudinal axis. The latch member 42 is preferably constructed of a shape memory material such as semi-rigid plastic or a shape-memory metal such that while the latch member 42 may be bent slightly, it is naturally biased to return to the straight configuration of its longitudinal axis.

The latch assembly further includes a bracket support member 46 mounted to the rear surface 18 of the cover plate 12 and extending rearwardly therefrom (FIG. 2). It should be observed that a bottom wall of the support member 46 presents an arcuate configuration that is substantially similar and complementary to the angular path followed by the pivotal movement of the electric box 24. This is important as further described below.

The latch assembly 40 further includes a track structure 50 imbedded into or defined by the bottom wall of the support member 46. Of course, the track structure 50 could be an independent component mounted to the electric box and extending therefrom. The track structure 50 preferably presents a series of grooves arranged in a generally Y-shaped configuration (FIG. 4) along which a tip 44 of the latch member 42 is positioned to engage and travel. More particularly, the track structure 50 includes a deep slot 52 extending substantially between the cover plate 12 and a distal end 48 of the support member 46 relative to the cover plate 12. A portion of the deep slot 52 near the cover plate 12 is substantially within the longitudinal axis defined by the latch member 42 while the remainder of the deep slot 52 is arranged at an angle displaced from the axis. Therefore, the latch member 42 is urged away from its normally biased configuration as it moves rearwardly along the deep slot 52.

Figure 4:
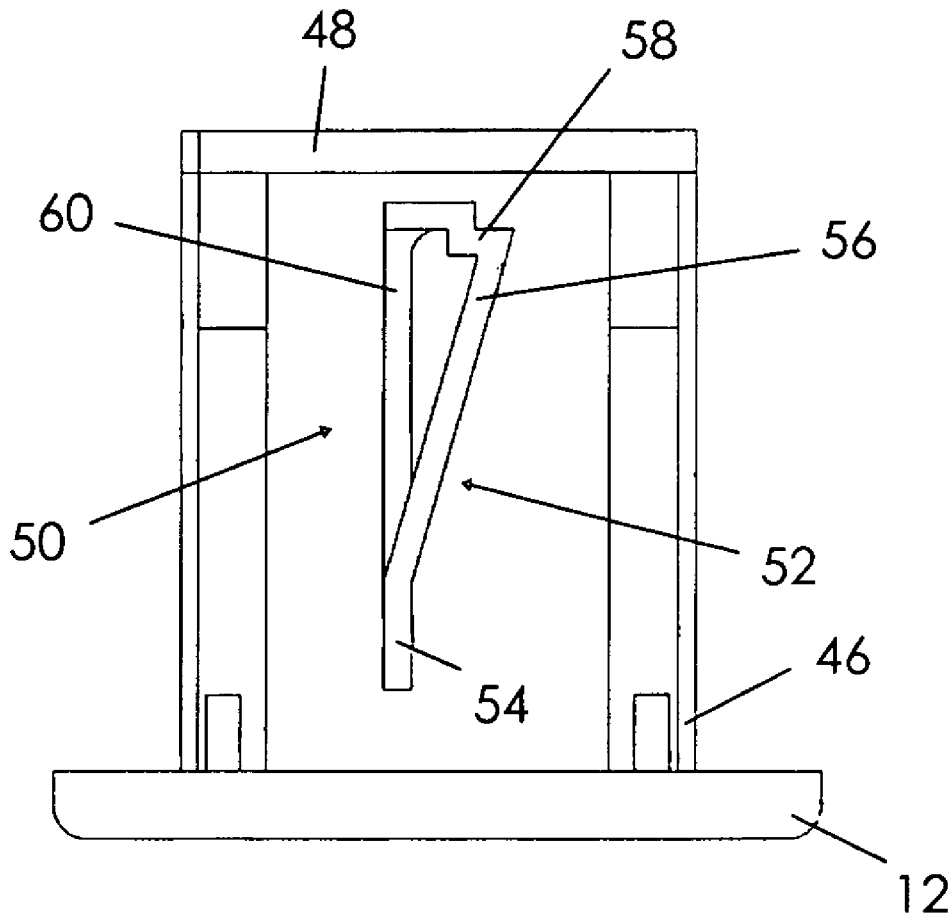
FIG. 4 is a top view of the wall outlet assembly.

The track structure 50 further presents a recess 58 or notched section connected to the distal end 56 of the deep slot 52 relative to the cover plate 12, the recess 58 being situated between the deep slot 52 and the path of the latch member's longitudinal axis (FIG. 4). The recess 58 includes a configuration for capturing the tip 44 of the latch member 42 when the latch member 42 is urged to the distal end of the deep slot 52. It is understood that the flexible latch member 42 is normally biased to return to its configuration within its original longitudinal axis and thus is normally urged into the recess 58.

Still further, the track structure 50 includes a shallow slot 60 substantially aligned within the longitudinal axis of the latch member 42 and connecting the recess 58 with a proximal end 54 of the deep slot 52. Therefore, the latch member 42 may be urged beyond the recess 58 and into the shallow slot 60 wherein the latch member 42 may be guided back to the start of the deep slot 52. The tip 44 of the latch member 42 would there be deposited into the deeper slot. It should be appreciated that the depth differences between the deep 52 and shallow 60 slots properly guides the latch member 42 about the track structure 50. It is also understood that the normal bias of the latch member 42 enables the latch member 42 to automatically move into the shallow slot 60 once it is urged beyond the recess 58.

Figure 5:
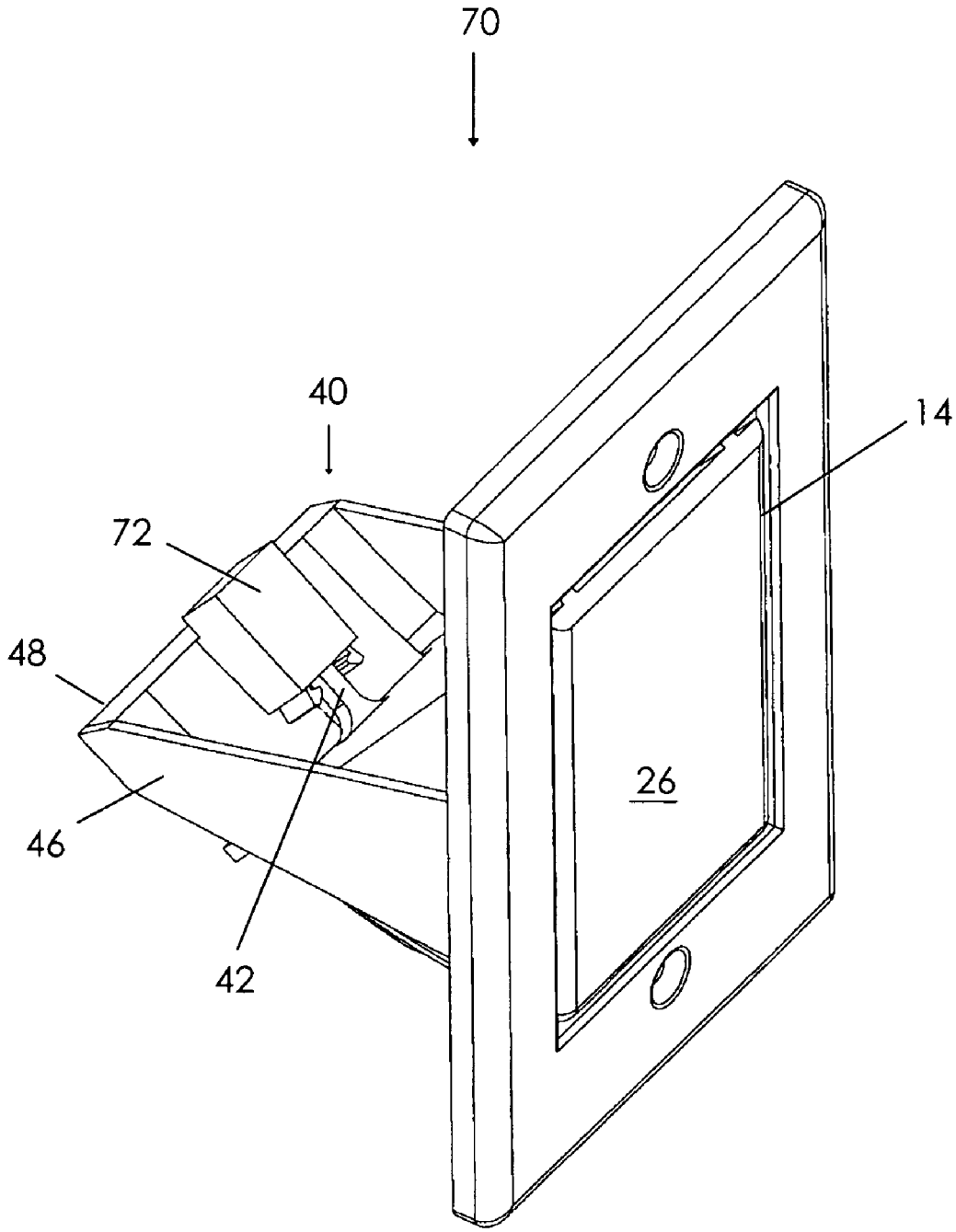
FIG. 5 is a perspective view of a wall outlet assembly according to another embodiment of the present invention.

In operation, the electric box is normally biased by the torsion spring 22 toward the extended configuration (FIG. 1) in which the receptacles 32 are accessible and operational. This assumes, of course, that the electric box 24 has been electrically connected to appropriate electric wires 36 within a conventional wall outlet housing 8 (FIG. 3). The electric box 24 may be urged toward the retracted configuration upon user depression of the electric box front surface 26. Such user pressure causes the latch member 42 to engage and travel along the deep slot 52 toward the distal end 56 thereof, the latch member 42 being urged increasingly further away from its normal longitudinal axis. Upon reaching the distal end 56 of the deep slot 52, the latch member 42 (specifically, the tip 44 thereof) is deposited into and captured by the recess 58 as the latch member 42 is biased to return in the direction of its longitudinal axis. The electric box 24 is then in the retracted configuration such that the receptacles 32 are not accessible (FIGS. 3 and 5). It is understood that the deep slot 52 is gradually inclined as it progresses toward connection with the shallow slot 60.

A further user depression of the electric box front surface 26 urges the latch member 42 out of the recess 58 and into the shallow slot 60. No longer captured, the torsion spring 22 urges the electric box 24 toward the extended configuration. Specifically, the tip 44 of the latch member 42 moves along the shallow slot 60 and is ultimately deposited into the deep slot 52.

The track structure 50 is preferred because of its simple construction and lack of working mechanical components. It is therefore less subject to mechanical failure and provides reliable push button operation. However, a retractable electric wall outlet assembly 70 according to another embodiment utilizes an alternative latch assembly that would also be suitable (FIG. 5). The electric wall outlet assembly 70 according to this embodiment includes a construction substantially similar to the construction first described above except as specifically noted below. More particularly, a push latch 72 is mounted to the distal end 48 of the support member 46 inline with the latch member 42 that extends from the rear of the electric box 24. When the electric box is urged by a user to the retracted configuration, the latch member 42 is engaged with and captured by the push latch 72. A second push of the electric box 24 releases the latch member 42 from the push latch 72 such that the electric box 24 may return to the extended configuration according to its spring bias.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A retractable electric wall outlet assembly, comprising:

a cover plate defining a generally rectangular opening;

an electric box having an electric plug receptacle, said electric box being coupled to said cover plate for movement between an inoperable configuration retracted through said opening rearward of said cover plate and an operable configuration extending through said opening forward of said cover plate;

means for biasing said electric box toward said operable configuration;

a latch assembly for releasably holding said electric box at said inoperable configuration;

wherein said latch assembly includes:

a latch member mounted to a rear surface of said electric box and extending outwardly;

a track structure mounted to a rear surface of said cover plate and extending outwardly, said latch member being positioned to engagingly move along said track structure when said electric box is moved between said operable and inoperable configurations; and wherein said track structure defines a recess for receiving and releasably holding said latch member when said electric box is at said inoperable configuration.

2. The retractable electric wall outlet assembly as in claim 1 wherein:

said electric box includes a generally rectangular configuration being dimensioned slightly smaller than dimensions of said cover plate opening such that said electric box can pass through said opening; and a front surface of said electric box is substantially flush with a front surface of said cover plate at said inoperable configuration and said electric box front surface is forwardly displaced from said front surface of said cover plate at said operable configuration.

3. The retractable electric wall outlet assembly as in claim 1 wherein said electric box is pivotally coupled to said face plate adjacent said opening such that said electric box is pivotally movable through said opening between said inoperable and operable configurations.

4. The retractable electric wall outlet assembly as in claim 3 wherein said biasing means is a torsion spring mounted to a rear surface of said face plate and connected to said electric box for biasing said electric box toward said operable configuration.

5. The retractable electric wall outlet assembly as in claim 1 wherein:

said track structure includes a generally Y-shaped configuration having a deep slot extending substantially between said rear surface of said cover plate and said recess and being in communication with said recess;

said latch member being constructed of a shape memory material, whereby said latch member is configured to engage and travel along said deep slot and is naturally biased to be deposited into said recess and retained therein when said electric box is moved to said inoperable configuration.

6. The retractable electric wall outlet assembly as in claim 5 wherein:

said track structure includes a shallow slot extending between said recess and a proximal end of said deep slot and being in communication therewith; and said latch member is naturally biased to engage said shallow slot when said latch member is urged beyond said recess such that said latch member travels along said shallow slot and is deposited in said deep slot when said electric box reaches said operable configuration.

7. The retractable electric wall outlet assembly as in claim 6 wherein:

said electric box is moved from said operable configuration to said inoperable configuration upon a first depression of said electric box; and said electric box is moved from said inoperable configuration and said operable configuration upon a second depression of said electric box.

8. A retractable electric wall outlet assembly for providing selective access to electric receptacles, comprising:

a generally flat cover plate having a rectangular configuration dimensioned to overlay a wall electric outlet opening, said cover plate defining a generally rectangular opening having dimensions substantially similar to dimensions of the wall electric outlet opening;

an electric box being pivotally coupled to said cover plate and having a plurality of electric plug receptacles, said electric box being movable through said cover plate opening between a retracted configuration in which an electric box front surface is generally flush with a cover plate front surface such that said plurality of electric plug receptacles are inaccessible and an extended configuration in which said electric box front surface is forwardly displaced from said cover plate such that said plurality of electric plug receptacles are accessible;

a spring coupled to said cover plate and connected to said electric box for biasing said electric box toward said extended configuration; and a latch assembly interconnecting said electric box and said cover plate for releasably holding said electric box in said retracted configurations;

wherein said latch assembly includes:

a latch member mounted to a rear surface of said electric box and extending outwardly;

a support member mounted to a rear surface of said cover plate and extending outwardly; and a push latch mounted to a distal end of said support member relative to said cover plate for selectively capturing and releasing said latch member.

9. The retractable electric wall outlet as in claim 8 wherein said spring is a torsion spring.

10. The retractable electric wall outlet assembly as in claim 8 wherein said support member includes a generally arcuate configuration corresponding to an angular path of the pivotal movement of said electric box.

11. The retractable electric wall outlet as in claim 8 wherein:

said electric box includes a generally rectangular configuration having dimensions slightly smaller than dimensions of said cover plate opening such that said electric box can pass through said opening; and a front surface of said electric box is substantially flush with a front surface of said cover plate at said retracted configuration and said electric box front surface is forwardly displaced from said front surface of said cover plate at said extended configuration.

12. A retractable electric wall outlet assembly for providing selective access to electric receptacles, comprising:

a generally flat cover plate having a rectangular configuration dimensioned to overlay a wall electric outlet opening, said cover plate defining a generally rectangular opening having dimensions substantially similar to dimensions of the wall electric outlet opening;

an electric box being pivotally coupled to said cover plate and having a plurality of electric plug receptacles situated on opposed side panels, said electric box being movable through said cover plate opening between a retracted configuration in which an electric box front surface is generally flush with a cover plate front surface such that said plurality of electric plug receptacles are inaccessible and an extended configuration in which said electric box front surface is forwardly displaced from said cover plate such that said plurality of electric plug receptacles are accessible;

a torsion spring coupled to said cover plate and connected to said electric box for biasing said electric box toward said extended configuration;

a latch assembly interconnecting said electric box and said cover plate for releasably holding said electric box in said retracted configuration, said latch assembly comprising:

a support bracket mounted to a rear surface of said cover plate and having a track structure;

a latch member mounted to a rear surface of said electric box and extending outwardly therefrom defining a longitudinal axis, said latch member being positioned to engage said track structure;

said track structure having a deep slot with a distal end displaced from said longitudinal axis, said latch member being naturally biased to return toward said longitudinal axis;

said track structure defining a recess in communication with said distal end of said deep slot for releasably capturing said latch member when said latch member is urged to said distal end of said deep slot; and said track structure defining a shallow slot connecting said recess with a proximal end of said deep slot when said latch member is urged out of said recess, said shallow slot being configured to guide said latch member to said deep slot proximal end when said electric box is moved from said retracted configuration to said extended configuration.

* * * * *